United States Patent [19]

Miller et al.

[11] 3,939,500

[45] Feb. 24, 1976

[54] WATER CLOSET

[75] Inventors: Marshall W. Miller; Christiaan J. H. Vanden Broek, both of Ann Arbor, Mich.; Benjamin H. Stansbury, Jr., Beverly Hills; Thomas H. Jamison, Culver City; Charles W. McHose, Hawthorne; Paul T. Dubson, Westchester, all of Calif.

[73] Assignee: Thetford Corporation, Ann Arbor, Mich.

[22] Filed: Dec. 21, 1973

[21] Appl. No.: 427,338

[52] U.S. Cl. ..... 4/10; 4/85

[51] Int. Cl.² ..... E03D 11/00; E03D 11/10

[58] Field of Search ..... 4/1, 8, 10, 11, 67 R, 76–81, 4/83–88, 115, 92, 128, 129, 249; 137/636; 251/315, 317

[56] References Cited

UNITED STATES PATENTS

| | | | |
|---|---|---|---|
| 2,204,704 | 6/1940 | Schomacher | 4/85 |
| 2,763,871 | 9/1956 | Rutherford | 4/85 X |
| 2,820,967 | 1/1958 | Dean et al. | 4/85 X |
| 3,251,068 | 5/1966 | Milette et al. | 4/78 |
| 3,369,260 | 2/1968 | Sargent et al. | 4/85 X |
| 3,577,569 | 5/1971 | Sargent et al. | 4/79 |
| 3,779,509 | 12/1973 | Vandenbrock | 251/315 X |
| 3,798,681 | 3/1974 | Johansen | 4/85 |
| 3,829,905 | 8/1974 | Vanden Broek | 4/79 X |

*Primary Examiner*—Richard E. Aegerter
*Assistant Examiner*—S. Levy
*Attorney, Agent, or Firm*—Olsen and Stephenson

[57] ABSTRACT

A water closet assembly adapted to be mounted on any one of a variety of bases for discharge of waste material into a drainage system, a holding tank, or the like, and which includes features for making optimum use of the flush water. The assembly includes a bowl and a pivotally mounted pan for closing the discharge outlet of the bowl and shaped so that it can provide a water seal when the pan is in its closed position. The pan can be tilted to an open position to discharge the contents of the bowl, and the actuator mechanism for tilting the bowl is operable to open a valve so that flush water will flow into the bowl in timed relation to movement of the pan. The bowl and pan are shaped to make most effective use of the flush water and to provide a desired water spot in the bowl, and an accumulation chamber is provided to measure a desired quantity of water for refilling the pan after a flushing operation.

17 Claims, 7 Drawing Figures

FIG. 4
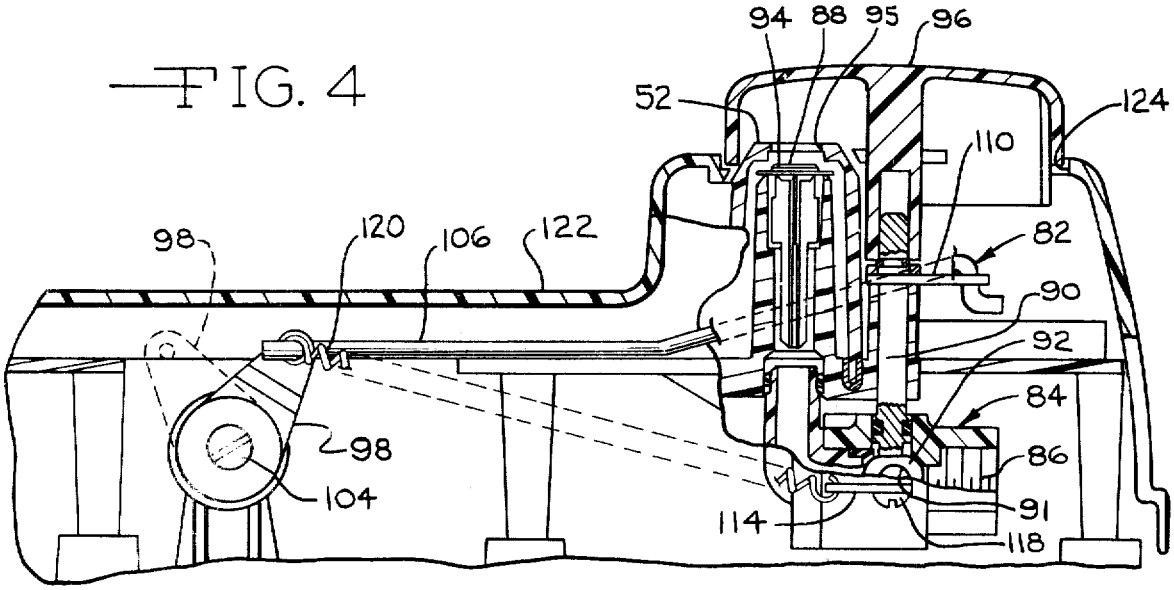
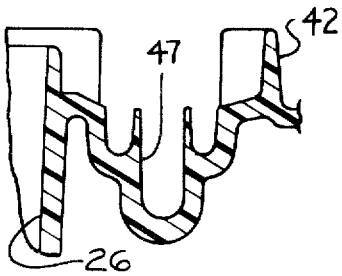
FIG. 3
FIG. 2
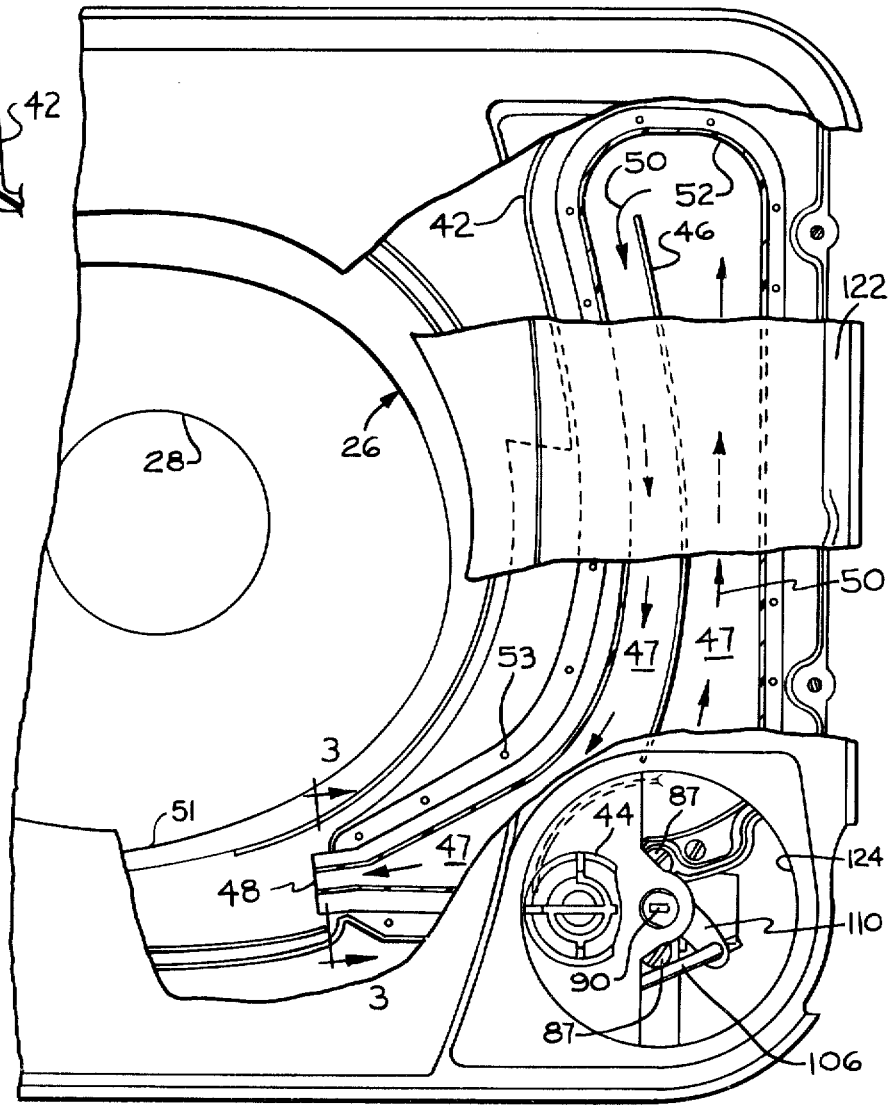

WATER CLOSET

REFERENCE TO RELATED APPLICATION

Reference is made to copending application, Ser. No. 258,901, filed June 1, 1972 in the name of Christiaan J. H. Vanden Broek now U.S. Pat. No. 3,779,509.

BACKGROUND OF THE INVENTION

This invention relates to improvements in water closets for conserving water and space, and which can be economically manufactured and sold while meeting these and other requirements.

Water conservation is progressively becoming a greater problem in our society, and one of the areas where waste of water resources occurs is in sanitation apparatus such as water closets and the like. The conventional water closets use substantial volumes of water for flushing purposes and for providing sanitary water seals or traps, and such volumes of water are excessive of that which is necessary merely for use as a vehicle to dispose of the waste and to provide a sanitary seal when the water closet is not in use. Some efforts have been made in the past to provide flushing apparatus different from that which is found in the conventional water closets in use today. Examples of the other efforts can be seen in U.S. Pat. No. Re. 5,066, reissued Sept. 24, 1872 to H. H. Craigie and in U.S. Pat. No. 3,251,068, issued May 17, 1966 to Kenneth A. Millette. These citations disclose the use of pivotal pans for holding flush water in the bowl, and for discharging waste materials from the bowl by tilting the pan so that some degree of water conservation occurs. However, these prior art efforts have failed to meet fully the needs for water closets which make the most effective use of the flush water and which are constructed and arranged to provide optimum space utilization and efficient movement of parts. Further, needs exist in the prior art for improved water closets that have actuating mechanisms for flushing purposes which are shielded or protected from damage from external sources or from corrosive or other harmful conditions that may exist within the water closet. Needs also exist for actuating mechanisms which have components constructed and arranged to provide ease of movement at all phases of the flushing operation to assure substantially effortless operation and long, trouble-free life of the flush actuating mechanisms.

SUMMARY OF THE INVENTION

The present invention has overcome the inadequacies of the prior art, and provides a water closet that meets the needs of today and which can be produced in an economical manner and which has application in a variety of forms of water closet installations.

According to one form of the present invention, a water closet is provided having a bowl with an open lower end, a concave pan beneath the bowl supported thereon adjacent to the upper end for pivotal movement about a horizontal axis between a first position in which the pan encloses the open lower end of the bowl and a second position in which the pan is tilted in an elevated position at one side of the bowl. The pan is in spaced relation to the bowl and has a depth so that when in its first position its peripheral lip is at a higher elevation than the open lower end of the bowl so that a water seal can be provided. Water flushing means are provided which are actuable for discharging flush water to the interior of the bowl. An actuator mechanism is connected to the pan and to the water flushing means for moving the pan to its second position and for simultaneously actuating the water flushing means to deliver flush water to the bowl while the pan is tilted and for returning the pan to its first position and for rendering the flushing means inactive. The actuator mechanism includes a control means, a crank operably connected at one end to the pan for pivotal movement around the axis of movement of the pan, and a link connected to the other end of the crank and to the control means for pivoting the crank and thereby the pan in response to movement of the control means. The water flush means includes a rotary ball valve for controlling the flow of water, and the control means for the actuating mechanism is rotatable and is connected to the ball valve for rotating the latter between its open and closed positions. The link is operably connected to the rotary control means for pivoting the crank and thereby the pan in response to rotary movement of the control means. This is accomplished by a second crank operably connected at one of its ends to the stem of the rotary ball valve for turning therewith, the other end of the crank being connected to the link. The rotary control means preferably is a knob mounted on the shaft of the ball valve and having finger grip portions for turning the knob in one direction to the open position of the ball valve. Spring means are provided urging the stem in the other direction to the closed position of the ball valve.

The water flushing means also includes a flush water accumulation chamber located adjacent to the upper end of the bowl and downstream of the ball valve for discharging by gravity a measured quantity of flush water into the bowl after the actuating mechanism has returned the pan to its first position and closed the valve. In the embodiment of the invention disclosed herein, the flush water accumulation chamber comprises a wall portion projecting laterally from the rear side of the bowl and defining a channel having a downward slope from its upstream end to its downstream end, the downstream end of the channel being directed into the upper end of the bowl tangentially thereof. To facilitate distribution of the water onto the interior surface of the bowl, the inner surface of the bowl defines a spiral ledge extending around the bowl, and the downstream end of the channel in the accumulation chamber is aligned with the upper edge of the ledge for delivering flush water onto the ledge. The water can then be discharged from the ledge in a vortex flow as is disclosed in U.S. Pat. No. 3,601,820, issued Aug. 31, 1971 to Charles L. Sargent et al.

Another feature of the present invention is the configuration of the bowl and the pan which provides optimum use of the water within the pan so that minimum water usage is required while providing a wet spot in the bowl of optimum size and configuration. The portion of the bowl forward of the open lower end has a circular curvature with its center essentially on the axis of pivotal movement of the pan, and the portion of the bowl to the rear of the open lower end has a relatively steeper upwardly inclined surface. The pan, when in its closed position, is in spaced relation to the bowl and has a depth and configuration which closely conforms to the shape of the enclosed lower portion of the bowl. Similarly, the portions of the bowl on opposite sides of the lower end thereof also have relatively steeper upwardly inclined surfaces than the portion of the bowl forward of the open lower end, and the pan also conforms to the shape of these portions of the bowl.

Another feature of the present invention is the arrangement wherein a base is provided having a hollow interior and having an upper annular portion on which the bowl can be mounted. The bowl has an open upper end with a downturned flange around the outer periphery thereof, and the downturned flange is positioned on and secured to the upper annular portion of the base. The pan has outwardly extending hubs which are mounted in apertures in the downturned flange of the bowl for pivotal movement, and the actuator mechanism is positioned externally of the downturned flange so as to be protected from the corrosive or harmful conditions that may exist within the base. The base has a second upper annular portion outwardly spaced from the first-named upper annular portion on which the bowl is mounted, and a top wall is mounted on the second annular portion and extends inwardly to overlie the open upper end of the bowl so that the actuator mechanism is confined within the space between the two upper annular portions, the bowl and the top wall, thereby protecting the actuator mechanism from damage from any external source.

Another feature of the present invention is the arrangement whereby the base is a separate component from the remaining water closet assembly so that the assembly can be positioned on any of a variety of bases, such as a conventional base having a closet flange for mounting on a discharge outlet to a sewer system, or it can be mounted on a holding tank, or on other bases of desired configurations or sizes which have standard upper annular portions for mounting of the remaining water closet assembly.

Still another feature of the present invention relates to the vacuum breaker apparatus which is constructed and arranged in association with the water accumulation chamber so that if water should inadvertently be discharged through the vent port of the vacuum breaker, the water so discharged will flow into the bowl of the water closet essentially the same as the flush water.

Thus, it is an object of the present invention to provide an improved water closet that more nearly meets the needs of today than the water closets comprising the prior art.

Other objects of this invention will appear in the following description and appended claims, reference being had to the accompanying drawings forming a part of this specification wherein like reference characters designate corresponding parts in the several views.

BRIEF DESCRIPTION OF THE DRAWINGS

FIG. 2 is a fragmentary top plan view with portions broken away to illustrate various features of the present invention;

FIG. 3 is an enlarged fragmentary section taken on the lines 3—3 of FIG. 2;

FIG. 4 is a fragmentary section with portions broken away, showing details of the water flush means and the actuator mechanism;

DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Figure 1A:
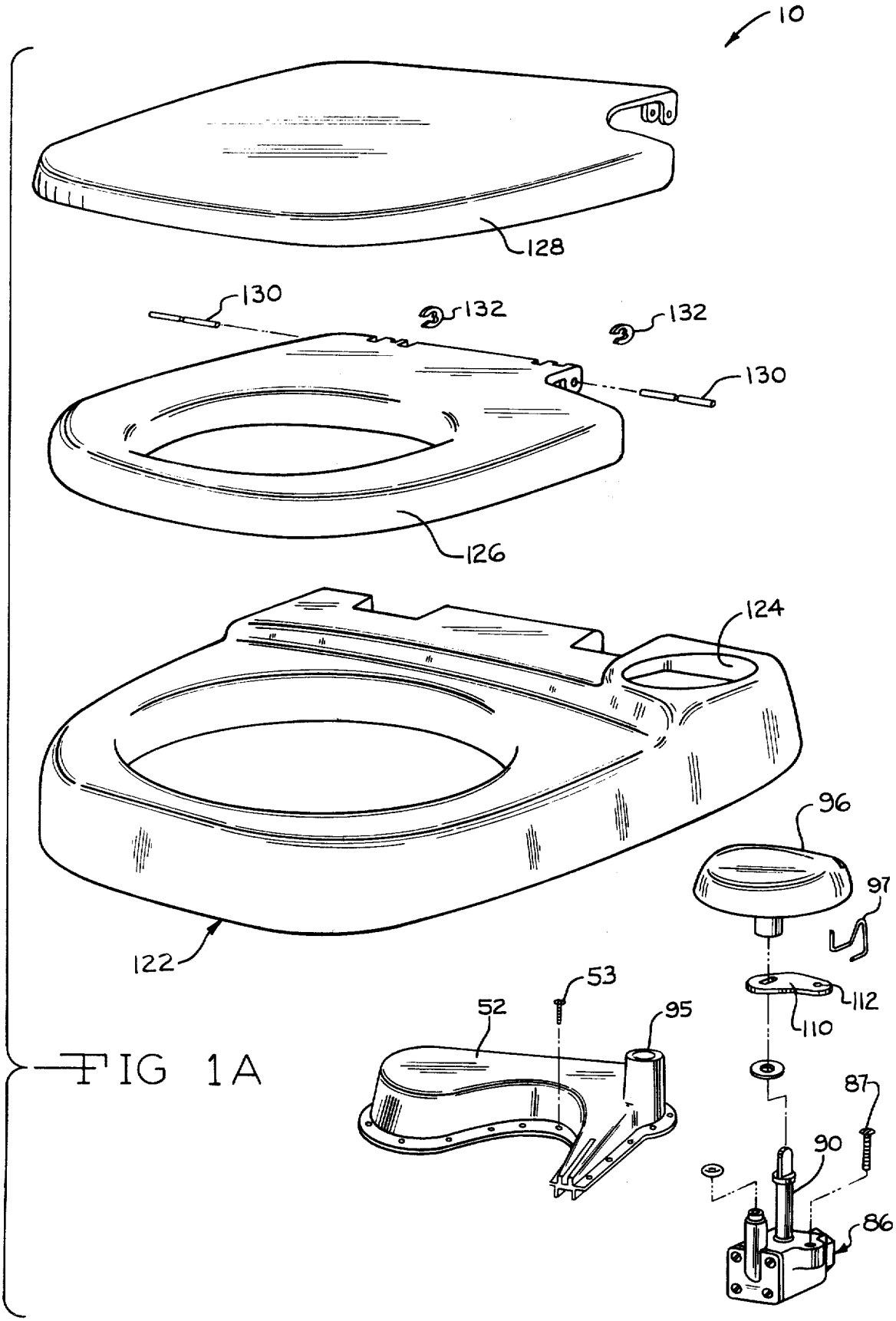
FIGS. 1A and 1B are an exploded perspective view of a water closet embodying the present invention.
Figure 1B:
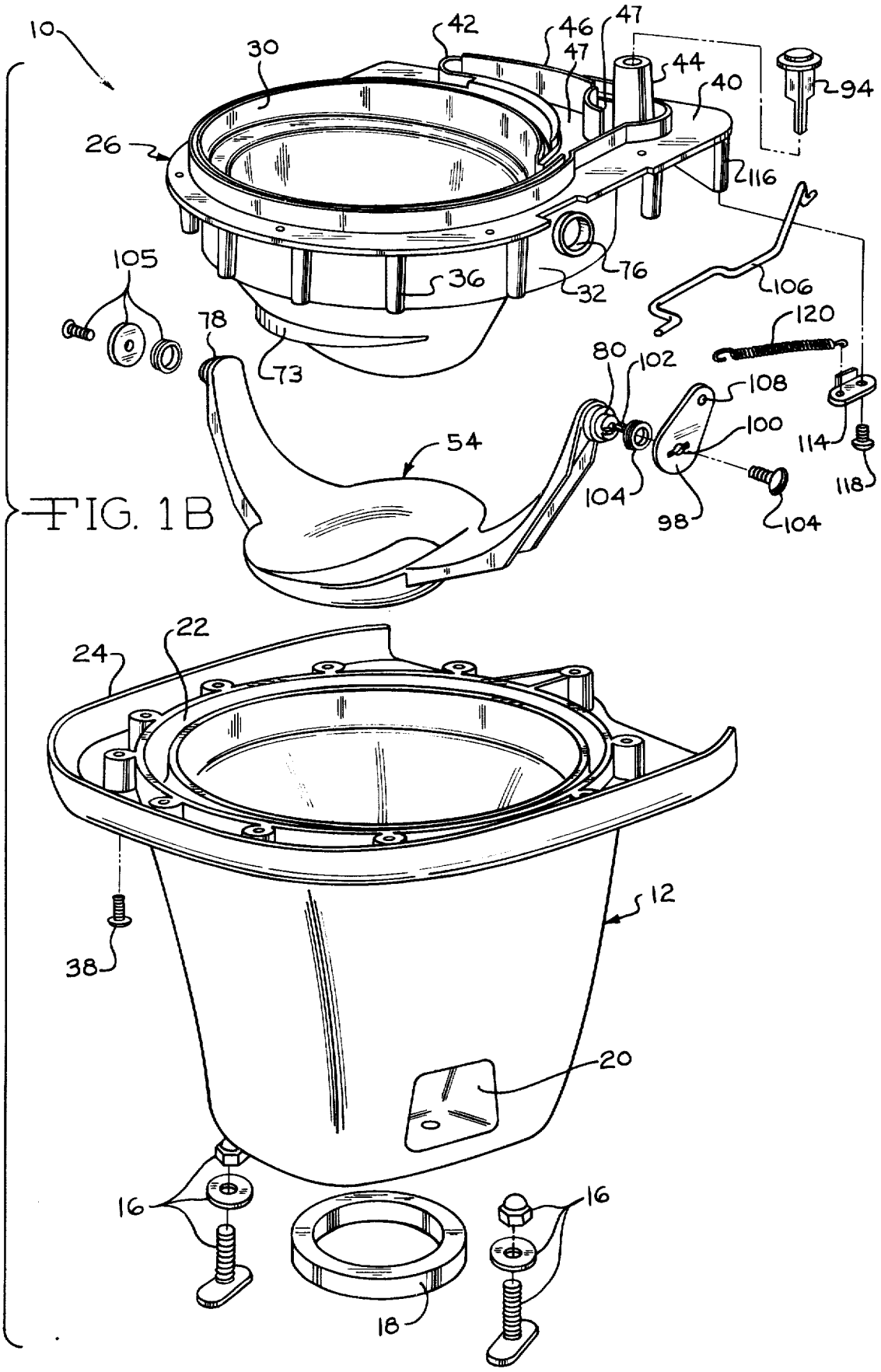
Figure 6:
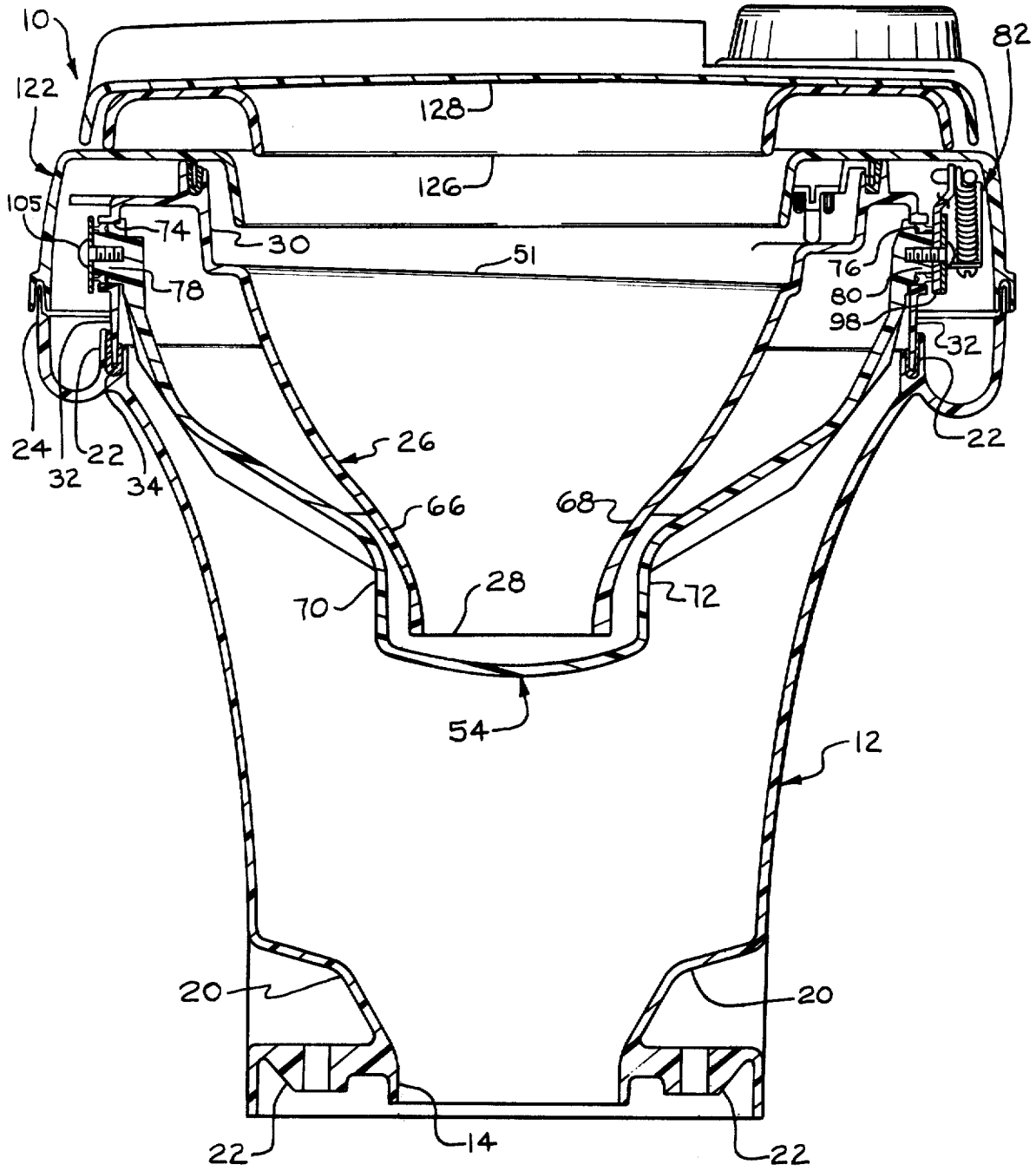
FIG. 6 is a vertical section through the water closet taken on the axis of pivotal movement of the pan of the water closet.

Referring now to the drawings, the invention will be described in greater detail. The water closet 10 includes a base 12 which in the illustrated embodiment is molded from a suitable organic plastic material and has an outlet 14 at the lower end for discharge into a conventional outlet drain. The screw and nut assemblies 16 may be used in conjunction with the seal ring 18 for securing the base 12 to a conventional closet flange (not shown) forming a part of the drainage system. As shown best in FIGS. 1B and 6, cavities 20 can be molded in the base 12 to provide mounting lugs 22 through which the screw and nut assemblies 16 can pass and be secured. The present invention is not restricted to a base having the mounting means described, because various other configurations of a base may be used, and if desired, the base 12 may be in the form of a holding tank, for example.

The base 12 has a hollow interior and an upper annular portion 22 providing a continuous groove, and a second annular portion 24 which is interrupted at the rear of the base 12, the second annular portions 24 being located outwardly of the first-named annular portion 22. The upper annular portion 22 serves as a mounting place for the bowl 26. The latter has an open lower end 28 and an open upper end 30 with a downturned flange 32 around the outer periphery of the open upper end 30. The downturned flange 32 is positioned with its terminal edge in sealed relation in the groove of the upper annular portion 22 of the base 12. A suitable sealant material 34 provides a hermetic seal between the lower terminal end of the flange 32 and the upper annular portion 22. Bosses 36 are provided around the outer periphery of the bowl 26 into which a plurality of screws 38 extend for securing the bowl 26 to the base 12. Extending outwardly from the upper end 30 and forming an integral part of the bowl 26 is the ledge 40 which defines a flush water accumulation chamber 42. The accumulation chamber has a vacuum breaker riser 44 at its one end through which flush water can be introduced into the accumulation chamber as will be described hereafter. A baffle 46 extends lengthwise through the accumulation chamber 42 so as to provide a channel 47 with a downward slope for flow of flush water from the riser 44 to the outlet end 48 of the channel 47 along the path indicated by the arrows 50. Water following the path indicated by arrows 50 will be discharged into bowl 26 onto the spiral ledge 51 for vortex flow to the lower end 8 as is described in greater detail in the aforesaid U.S. Pat. No. 3,601,820. A vacuum breaker cover 52 is provided for fitting within the accumulation chamber 42 and restricting the width of the channel 47. The cover 52 is secured to the ledge 40 by a plurality of screws 53.

Figure 5:
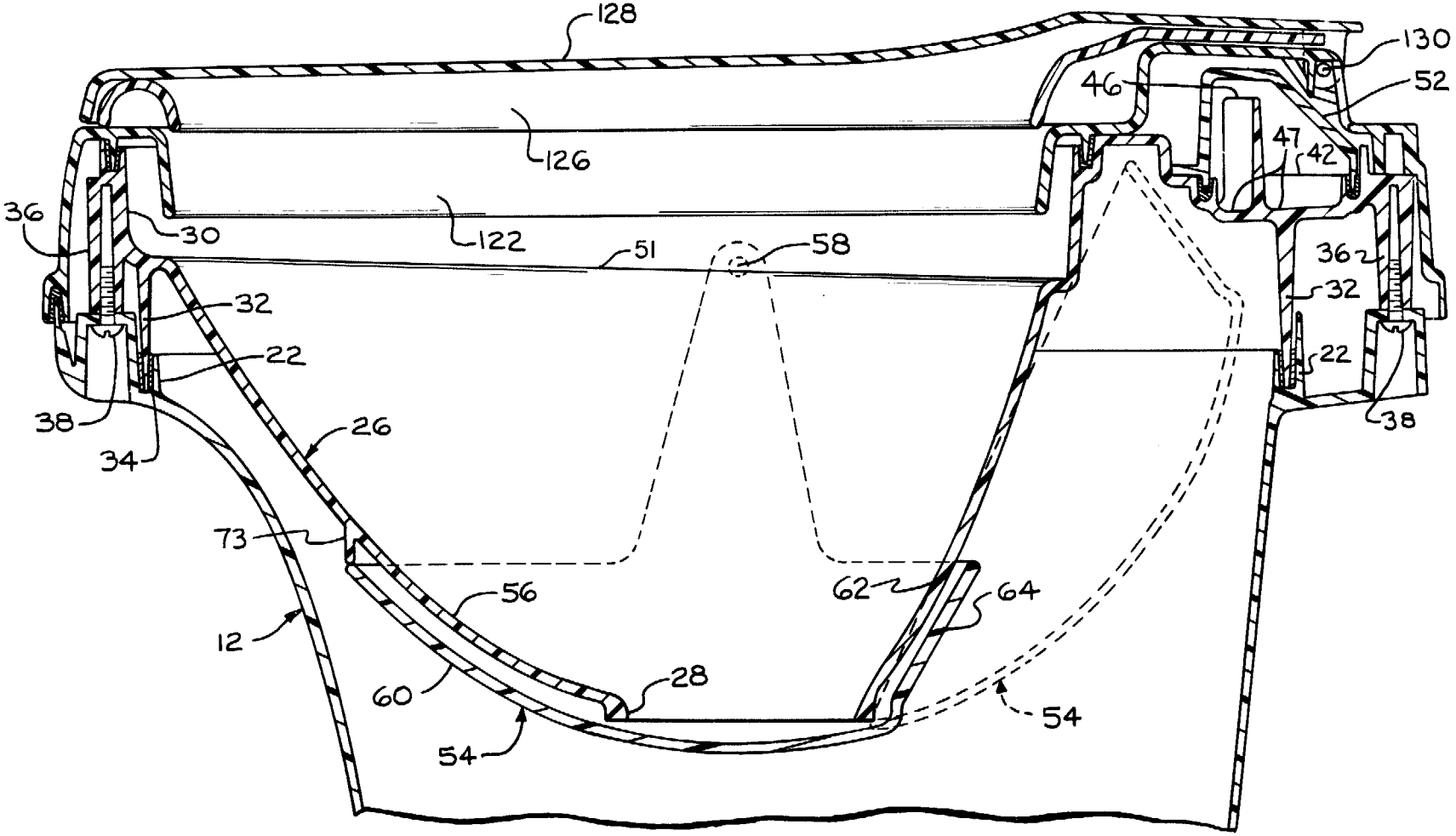
FIG. 5 is a fragmentary vertical section taken through the middle of the water closet from the front to the rear thereof.

A concave pan 54 is positioned beneath the bowl 26, and is supported on the downturned flange 32 for pivotal movement between a first position shown in solid lines in FIG. 5 in which the pan 54 encloses the open lower end 28 of the bowl 26 and a second position shown in broken lines in FIG. 5 in which the pan 54 is tilted at an elevated position at one side of the bowl 26. The portion 56 of the bowl 26 forward of the open lower end 28 has a circular curvature with its center essentially on the axis 58 about which the pan pivots. The pan 54 is in close spaced relationship to the bowl 26, and its forward portion 60 similarly has a circular configuration with its center also essentially on the axis 58. The portion 62 of the bowl 26 rearward of the open lower end 28 has a relatively steeper upwardly inclined surface and the rear portion 64 of the pan 54 conforms to this configuration of the bowl. As can be seen best in FIG. 6, the portions 66 and 68 on opposite sides of the bowl are relatively closer together than the front and rear portions 56 and 62 of the bowl and the pan has side portions 70 and 72 which conform generally to the shape of the side portions of the bowl 26. Thus, the pan conforms closely when in its first position to the configuration of the bowl so that only a limited amount of water is required between the exterior of the bowl and the interior of the pan to provide a water seal between the base 12 and the bowl 26. Also, by virtue of the configuration of the portions 56, 62, 66 and 68, a wet spot of desired dimension is provided in the bowl. Thus, minimum water is required to serve as a sealant and also to provide the desired wet spot in the bowl 26, and the curvatures provided at the portion 56 of the bowl and the portion 60 of the pan assure that a minimum dimension is required between the bottom of the pan 54 and the upper edge of the bowl 26. The bowl 26 also has a flange or abutment 73 depending from its bottom surface against which the forward lip of the pan 54 can abut when in its first position. This flange or abutment can also function as a baffle to restrict loss of water from the pan if the water closet 10 is subjected to motion, such as might occur if it were in a travel vehicle, for example.

As previously indicated, the pan 54 is supported for pivotal movement on the downturned flange 32 of the bowl 26. For this purpose, the downturned flange 32 has aligned holes 74 and 76 on the axis of pivotal movement of the pan 54, and the pan 54 has hubs 78 and 80 extending outwardly through these holes for supporting the pan. As actuator mechanism 82 is connected to the hub 80 for pivoting the pan 26 between its first and second positions.

Associated with the actuator mechanism 82 is the water flush means 84 which includes the rotary ball valve 86, the vacuum breaker means 88 and the accumulation chamber 42. The ball valve 86 is secured to the bowl 26 by screws 87 and preferably is constructed according to the teachings found in pending application Ser. No. 258,901, filed June 1, 1972 in the name of Christiaan J. H. Vanden Broek, but in the embodiment illustrated in the present application, the valve stem 90 extends vertically upward. For a detailed description of the ball valve 86, reference is made to the copending application. When the ball 92 is rotated 90° by turning of the stem 90, the valve will be opened, and when returned to the position shown in FIG. 4, the hole 91 in the ball 92 will be aligned perpendicular with the passageway through the valve 86. When the valve is open water can flow through the riser 44, raising the float 94 to a elevated position so that the vent opening 95 is closed and so that water can flow into the accumulation chamber 42. When the stem 90 and thereby the ball 92 is rotated to its closed position the vacuum breaker float 94 will descend to a seated position on the riser 44. The vacuum breaker float 94 functions to prevent siphoning of water from the accumulation chamber back into the source of water supply. If water should inadvertently leak through the vent opening 95 for any reason, the water that has leaked will flow over the outer surface of the cover 52 and will be discharged into the bowl 26 at the outlet end 48 of the channel 47.

The actuator mechanism 82 is operatively connected to the pan 54 and to the water flushing means 82 for moving the pan to its second position and for simultaneously actuating the flushing means 82 to deliver flush water to the bowl 26 while the pan is tilted and for returning the pan to its first position and for rendering the flushing means inactive by closing the ball valve 86. The actuator mechanism 82 includes the control member or knob 96, which is properly located by clip 97, and the crank 98 which is connected at one end to the hub 80 of the pan 54 for pivotal movement around the axis of the pan. This is accomplished by providing a transverse slot 100 in the crank 98, the slot 100 fitting over the projections 102 in the hub 80 so that the crank must rotate with the hub 80. Suitable fastening means 104 are provided for securing the crank 98 in place on the hub 80. Other suitable fastening means 105 are associated with hub 78. A link 106 is connected to the other end of the crank 98 by means of the hole 108 therein, and longitudinal movement of the link 106 will serve to move the crank between the solid line position and the broken line position shown in FIG. 4. This movement of the crank 98 will serve to move the pan 54 between its first and second positions.

The actuator mechanism 82 also includes the second crank 110. The link 106 is operably connected to the rotary control means or knob 96 for longitudinal movement in response to rotation of knob 96. The operable connection is provided by the second crank 110 which is seated on the upper end of the ball valve stem 90 for rotation therewith. The crank 110 has an aperture 112 at one end for receiving the end of the link 106. Thus, rotation of the rotary control means or knob 96 will function simultaneously to turn the ball valve 86 between its closed and open positions and also to tilt the pan 54 between its first position enclosing the lower end of the bowl 26 and its second position wherein it is tilted to discharge the contents of the pan. For the purpose of returning the rotary control means 96 to its position wherein the pan is in its first position, a bracket 114 is secured to the bowl at the flange 116 by the screw 118, and a coil spring 120 is connected between the bracket 114 and the link 106 to urge the latter to the position wherein the crank 98 is shown in its solid line position in FIG. 4. Preferably, the knob 96 has finger recesses for turning the knob 96 only in one direction in opposition to the action of coil spring 120.

A top wall 122 is mounted on the second annular portion 24 of the base 12 and extends inwardly to overlie the upper end of the bowl 26 so that the actuator mechanism 82 extends through the space defined between the upper annular portions 22 and 24, the bowl 26 and the top wall 122. Thus, the actuator mechanism 82 is completely protected within this confined space, and only the knob 96 is exposed to the exterior through the opening 124 in the top wall 122. By virtue of being confined in this space, the actuating mechanism is also protected against any harmful or corrosive effects that may emanate from the space within the hollow base 12.

Mounted above the top wall 122 in hinged relation thereto is the seat 126 and the cover 128. The latter two are pivotally connected to the top wall 122 by means of the pins 130 which are locked in place by the clips 132.

From the foregoing description it will be understood that when the knob 96 is rotated against the action of the spring 120, the ball valve 86 will be opened and simultaneously the pan 54 will be pivoted to its tilted or second position. The water will flow from the ball valve 86 to the accumulation chamber, and when the flushing of the bowl 26 is to be terminated, the knob 96 will be released and the spring 120 will then return the pan to its first or lowered position and simultaneously the ball valve 86 will be closed. The water which has accumulated in the accumulation chamber 42 will then flow through the channel 47 into the interior of the bowl 26 to provide a measured quantity of water therein so that an effective water seal is provided between the pan 54 and the bowl 26 and a wet spot in the bowl 26 of maximum effective area than exists consistent with minimum volume of water in the pan.

It is claimed:

1. A water closet comprising a bowl having an open upper end and an open lower end, a concave pan beneath said bowl and supported thereon at the upper end thereof for pivotal movement about a horizontal axis between a first position in which said pan encloses said open lower end and a second position in which said pan is tilted in an elevated position at one side of said bowl, said pan being in spaced relation to said bowl and having a depth so that when in its first position its peripheral lip is at a higher elevation than the open lower end of said bowl, water flushing means actuable for discharging flush water to the interior of said bowl, and an actuator mechanism connected to said pan and to said water flushing means for moving said pan to its second position and for simultaneously actuating said flushing means to deliver flush water to the bowl while the pan is tilted and for returning the pan to its first position and for rendering said flushing means inactive, said actuator mechanism including a control means, a crank having at one end a crank axis coincident with said horizontal axis, said crank being operably connected at said one end to said pan for pivotal movement with said pan around said horizontal axis, and a link connected to the other end of said crank and to said control means for pivoting said crank and thereby said pan around said horizontal axis in response to movement of said control means.

2. The water closet that is defined in claim 1, wherein said water flush means includes a rotary ball valve for controlling flow of the flush water, and the control means of said actuating mechanism is rotatable and is connected to said ball valve for rotating the latter between its open and closed positions, said link being operably connected to said rotary control means for pivoting said crank and thereby said pan in response to rotary movement of said control means.

3. The water closet that is defined in claim 2, wherein said actuating mechanism includes a second crank operably connected at one of its ends to the stem of said rotary ball valve for turning therewith, the other end of said second crank being connected to said link.

4. The water closet that is defined in claim 3, wherein said rotary control means includes a knob mounted on the shaft of said ball valve having finger grip portions for turning said knob in one direction to the open position of said ball valve, and spring means for urging said stem in the other direction to the closed position of said ball valve.

5. A water closet comprising a bowl having an open lower end, a concave pan beneath said bowl supported for movement between a first position in which said pan encloses said open lower end and a second position in which said pan is tilted in an elevated position at one side of said bowl, said pan being in spaced relation to said bowl and having a depth so that when in its first position its peripheral lip is at a higher elevation than said open lower end, water flushing means actuable for discharging flush water to the interior of said bowl, and an actuator mechanism connected to said pan and to said water flushing means for moving said pan to its second position and for simultaneously actuating said flushing means to deliver flush water to the bowl while the pan is tilted and for returning the pan to its first position and for rendering said flushing means inactive, said water flushing means including a valve adapted to be opened to supply flush water, a flush water accumulation chamber located adjacent to the upper end of said bowl and downstream of said valve for discharging by gravity a measured quantity of flush water into said bowl after said actuating mechanism has returned the pan to its first position and closed said valve, said flush water accumulation chamber including a wall portion projecting laterally from the rear side of said bowl and defining a channel having a downward slope from its upstream end to its downstream end, the downstream end of said channel being directed into the upper end of said bowl tangentially thereof.

6. The water closet that is defined in claim 5, wherein a vacuum breaker riser extends upward in said accumulation chamber at the upstream end of said channel through which flush water can enter said accumulation chamber from said valve.

7. The water closet that is defined in claim 6, wherein said vacuum breaker riser is located to the rear of and laterally of said bowl, and said channel extends transversely of said bowl and has a reverse bend with the downstream end thereof discharging tangentially into said bowl at a location adjacent to said riser.

8. The water closet that is defined in claim 5, wherein said bowl defines in its inner wall a spiral ledge extending around said bowl, and the downstream end of said channel is aligned with the upper end of said ledge for delivering flush water onto said ledge.

9. A water closet comprising a bowl having an open upper end and an open lower end, a concave pan beneath said bowl supported for pivotal movement between a first position in which said pan encloses said open lower end and a second position in which said pan is tilted in an elevated position at the rear of said bowl, said pan being supported for pivotal movement around an axis located at the upper end of the bowl and in a vertical transverse plane passing essentially through the center of said open lower end, the portion of the bowl forward of said open lower end having a circular curvature with its center essentially on said axis and the portion of the bowl to the rear of said open lower end having a relatively steeper upwardly inclined surface, the portions of said bowl on opposite sides of said open lower end having relatively steeper upwardly inclined surfaces than said portion of the bowl forward of said open lower end, said portions on opposite sides being relatively closer together than the front and rear portions of said bowl, said pan being in spaced relation to said bowl and having a depth and a configuration so that when in its first position the peripheral lip of the pan is at a higher elevation than said open lower end and the pan closely conforms to the shape of the enclosed lower portion of the bowl, water flushing means actuable for discharging flush water to the interior of said bowl, said pan conforming to the shape of the enclosed lower portion of the bowl so as to provide a wet spot of maximum effective area in the bowl consistent with minimum volume of water when the pan contains water above the level of the lower end of the bowl, an actuator mechanism connected to said pan and to said water flushing means for moving said pan to its second position and for simultaneously actuating said flushing means to deliver flush water to the bowl while the pan is tilted and for returning the pan to its first position and for rendering said flushing means inactive, and a flush water accumulation chamber located adjacent to the upper end of said bowl and downstream of said flushing means for discharging by gravity a measured quantity of flush water into said bowl after said actuating mechanism has returned the pan to its first position.

10. The water closed that is defined in claim 9, wherein said bowl defines in its inner wall a spiral ledge extending around said bowl, and said accumulation chamber has a downstream end for discharging the measured quantity of flush water tangentially into said bowl onto the upper end of said ledge.

11. A water closet comprising a base with a hollow interior and having an upper annular portion for mounting a bowl, a bowl having an open lower end and an open upper end with a downturned flange around the outer periphery thereof, said downturned flange being positioned on and secured to the upper annular portion of said base, a concave pan beneath said bowl supported on the downturned flange for movement between a first position in which said pan encloses said open lower end and a second position in which said pan is tilted in an elevated position at one side of said bowl, the portion of the bowl forward of said open lower end having a circular curvature with its center essentially on the axis of movement of the pan and the portion of the bowl to the rear of said open lower end having a relatively steeper upwardly inclined surface, said pan being in spaced relation to said bowl and having a depth and a configuration so that when in its first position the peripheral lip of the pan is at a higher elevation than said open lower end and the pan closely conforms to the shape of the enclosed lower portion of the bowl, water flushing means actuable for discharging flush water to the interior of said bowl, and an actuator mechanism on the outer side of said downturned flange operatively connected to said pan and to said water flushing means for moving said pan to its second position and for simultaneously actuating said flushing means to deliver flush water to the bowl while the pan is tilted and for returning the pan to its first position and for rendering said flushing means inactive, said water flushing means including a valve adapted to be opened to supply flush water, a flush water accumulation chamber located adjacent to the upper end of said bowl and downstream of said valve for discharging by gravity a measured quantity of flush water into said bowl after said actuating mechanism has returned the pan to its first position and closed said valve.

12. The water closet that is defined in claim 11, wherein said actuator mechanism includes a control member, a crank operably connected at one end to said pan for pivotal movement around said axis, and a link connected to the other end of said crank for pivoting said crank and thereby said pan in response to movement of said control member.

13. The water closet that is defined in claim 11, wherein said downturned flange has aligned holes on the axis of movement of said pan, and said pan has hubs extending outwardly through said holes for supporting the pan, said actuator mechanism being operatively connected to one of said hubs for moving said pan.

14. The water closet that is defined in claim 11, wherein said bowl defines in its inner wall a spiral ledge extending around said bowl, and said accumulation chamber has a downstream end for discharging flush water tangentially into said bowl onto the upper end of said ledge.

15. The water closet that is defined in claim 11, wherein said flush water accumulation chamber comprises a wall portion projecting laterally from the rear side of said bowl and defining a channel having a downward slope from its upstream end to its downstream end, the downstream end of said channel being directed into the upper end of said bowl.

16. The water closet that is defined in claim 11, wherein the forward portion of said bowl has a flange extending in a downward direction from its bottom wall for engagement with the forward portion of the peripheral lip of said pan.

17. A water closet comprising a bowl having an open lower end, a concave pan beneath said bowl supported for movement between a first position in which said pan encloses said open lower end and a second position in which said pan is tilted in an elevated position at one side of said bowl, said pan being in spaced relation to said bowl and having a depth so that when in its first position its peripheral lip is at a higher elevation than said open lower end, water flushing means actuable for discharging flush water to the interior of said bowl, and an actuator mechanism connected to said pan and to said water flushing means for moving said pan to its second position and for simultaneously actuating said flushing means to deliver flush water to the bowl while the pan is tilted and for returning the pan to its first position and for rendering said flushing means inactive, said water flushing means including a valve adapted to be opened to supply flush water, a flush water accumulation chamber located adjacent to the upper end of said bowl and downstream of said valve for discharging by gravity a measured quantity of flush water into said bowl after said actuating mechanism has returned the pan to its first position and closed said valve, said flush water accumulation chamber including a wall portion projecting laterally from the rear side of said bowl and defining a channel having a downward slope from its upstream end to its downstream end, the downstream end of said channel being directed into the upper end of said bowl tangentially thereof, and a vacuum breaker riser extending upward in said accumulation chamber at the upstream end of said channel through which flush water can enter said accumulation chamber from said valve, said accumulation chamber including a cover with a vent opening aligned with said vacuum breaker riser, and a vacuum breaker float mounted in said riser for reciprocal movement between a first position closing the upper end of said riser and in response to flush water pressure to an elevated position closing said vent opening, said cover having a configuration so that if flush water should inadvertently be discharged through said vent opening the discharged water will flow to said bowl.

* * * * *